United States Patent [19]

Maher

[11] Patent Number: 5,003,808

[45] Date of Patent: Apr. 2, 1991

[54] SYSTEM FOR TRANSFERRING WORKPIECES THROUGH A SERIES OF WORK STATIONS

[76] Inventor: John H. Maher, 6742 River Rd., Flushing, Mich. 48433

[21] Appl. No.: 365,201

[22] Filed: Jun. 15, 1989

Related U.S. Application Data

[63] Continuation-in-part of Ser. No. 210,368, Jun. 23, 1988, Pat. No. 4,887,446.

[51] Int. Cl.[5] ..... B21J 13/08

[52] U.S. Cl. ..... 72/405; 72/421; 198/621

[58] Field of Search ..... 72/405, 421; 198/621; 414/751, 750

[56] References Cited

U.S. PATENT DOCUMENTS

| | | | |
|---|---|---|---|
| 3,760,957 | 9/1973 | Berger | 72/405 |
| 4,272,981 | 6/1981 | Endter | 72/405 |
| 4,540,087 | 9/1985 | Mizumoto | 72/405 |
| 4,604,021 | 8/1986 | Werner | 72/405 |
| 4,621,516 | 11/1986 | Schafer | 72/405 |
| 4,653,311 | 3/1987 | Tack | 72/405 |
| 4,688,668 | 8/1987 | Ookubo et al. | 414/750 |
| 4,785,657 | 11/1988 | Votava | 72/405 |
| 4,873,860 | 10/1989 | Werner | 72/405 |

FOREIGN PATENT DOCUMENTS

| | | | |
|---|---|---|---|
| 34758 | 7/1970 | Japan | 72/405 |
| 48308 | 8/1983 | Japan | 72/405 |
| 283426 | 12/1986 | Japan | 72/405 |
| 175803 | 10/1965 | U.S.S.R. | 72/405 |

*Primary Examiner*—Daniel C. Crane
*Attorney, Agent, or Firm*—Krass & Young

[57] ABSTRACT

A system for transferring workpieces through a series of linearly aligned, equally spaced work stations where a predetermined sequence of operations are performed thereon. The workpieces are transferred along an X axis by a plurality of workpiece gripping finger operators mounted on a transfer rail at equally spaced locations thereon corresponding to the spacing of the work stations. The transfer rail is reciprocated along the X axis for a distance equal to the spacing between adjacent work stations. Independently supported actuator units are provided which have a lateral arm to support the transfer rail and to impart up and down and back and forth movement to it. The means for moving the workpiece in all three axes are individually controllable and may be coordinated with operation of, for example, a transfer press.

17 Claims, 13 Drawing Sheets

FIG - 4a
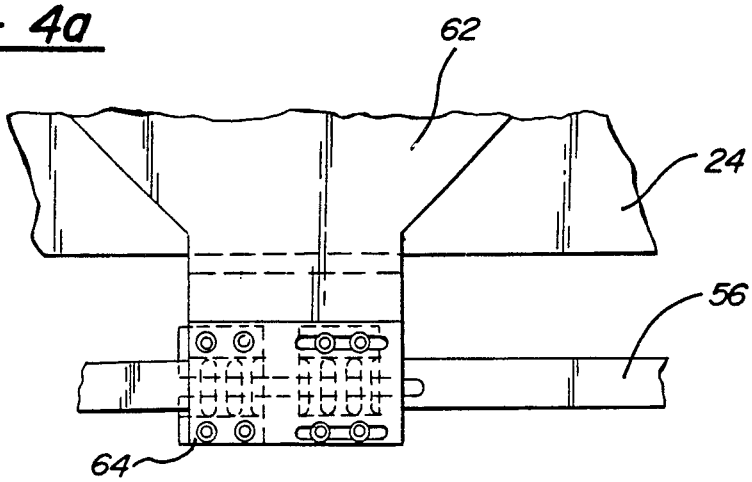
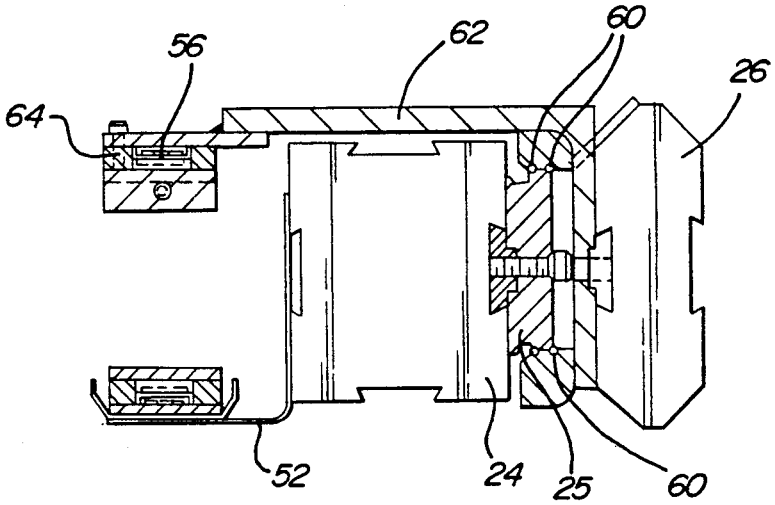
FIG - 4
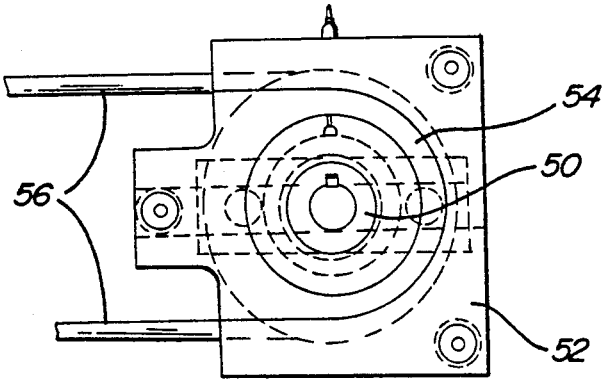
FIG - 5

SYSTEM FOR TRANSFERRING WORKPIECES THROUGH A SERIES OF WORK STATIONS

CROSS-REFERENCE TO RELATED APPLICATIONS

This application is a continuation-in-part of U.S. pending application Ser. No. 210,368, filed on June 23, 1988, now U.S. Pat. No. 4,887,446 entitled "System for Transferring Workpieces through a Series of Work Stations."

BACKGROUND OF THE INVENTION

1. Field of the Invention

This invention relates generally to production systems wherein workpieces are transferred through a series of equally spaced, linearly aligned work stations which perform a predetermined sequence of operations on the workpieces and, more particularly, to such a system for automatically transferring the workpieces from one work station to an adjacent work station within the system.

2. Description of the Relevant Prior Art

Automated and partly automated systems in which a workpiece is conveyed through a series of work stations which each perform one of a series of operations on the workpiece have rapidly become the norm in manufacturing industries such as the metal working industry. In manufacturing operations such as metal stamping, many separate stamping operations may be required to form the flat sheet of metal into an article such as, for example, a vehicle hubcap. Rather than utilizing several separate presses to stamp the part, it has become the industry standard to utilize a transfer feed press, a single stroke of which is used to perform multiple stamping operations at a plurality of work stations. Typically, a pair of matching dies are disposed above and below each work station. At each stroke of the press, a workpiece will be stamped between each pair of dies. As an individual workpiece moves through the series of work stations, it will be successively stamped by each pair of dies to form the finished product.

Obviously, for efficient operation of such a transfer press, it is critically important that a succession of workpieces be simultaneously transferred from one work station to the next between each stroke of the press. Furthermore, it is often necessary to realign the workpiece with the various die stations of the transfer press. For example, the workpiece may have to be moved linearly in either horizontal direction, or it may be necessary to rotate it. Typically, it is necessary to reorient the workpiece a number of times before forming of the piece is finished. It is readily apparent that some means of rapidly and accurately performing multiple transfers and repositionings must be provided.

One system for performing repetitive workpiece transfer and multiple realignment is a type of walking-beam system which provides transfer rails extending along both sides of a linear axis (x axis) through the work stations upon which the workpieces ride between each adjacent work station. Disposed on the transfer rails are finger grippers for gripping the workpieces. In this type of system, each of the rails is designed for movement along both the X and the vertical axis (Z axis), that is, it both raises and lowers the workpiece and moves it linearly from one work station to another. Furthermore, the finger grippers have associated actuators which permit them to move laterally (along the Y axis), toward and away from the workpieces for engagement therewith and disengagement therefrom. Thus, this design permits the finger grippers to first engage the workpiece by operation of its actuator, then raise the workpiece to the transfer level by actuation of the transfer rails, linearly move the workpiece to the next work station by further actuation of the transfer rails. lower the workpiece, and finally disengage from the workpiece by retracting the finger grippers therefrom so that the press may be operated.

Although such transfer systems are in wide use, they present many disadvantages. For example, many smaller stamping manufacturers and sheet metal die builders do not have transfer presses, which represent a substantial investment, but have a need to duplicate the action of a transfer press for die tryout purposes or short production runs.

Because a standard transfer press supports the rails at each end of the x-axis, rather than in the middle, the rails are typically very heavy, and have a cross section designed to minimize sag. Moving the mass of these rails at production speeds requires large gears and cams, and a massive framework to support the mechanism and provide stability thereto.

Furthermore, standard transfer presses typically have standardized rail positions and permit only two or three different spacings between the rails in the lifted position. Standard transfer presses also have only a limited number of settings along the x-axis and no adjustment of distance of travel in either the up-down or back-forth directions. To exacerbate this problem, the standardized settings are peculiar to each manufacturer and not standardized industry wide. Hence, it would be virtually impossible for one shop to have transfer presses capable of testing or running the many possible combinations of available settings from various press manufacturers.

A further problem with standard transfer presses is the lack of provision for easy removal of the rails for access for purposes of changing the dies. The transfer rails must be longer than the distance between the columns of the press since they also serve to load the workpiece into the press and unload it therefrom. Therefore, elaborate coupling mechanisms are necessary to allow removal of a portion of the rail when the tooling is removed. Die change capability is, therefore, an expensive option and permits rail change or removal only with great difficulty.

As a partial solution to some of these problems, U.S. Pat. No. 4,621,516 to Schafer et al discloses a system wherein the transfer rail does not travel in the linear direction from one station to another. Rather, a secondary rail is mounted thereon and the finger units are in turn mounted on the secondary rail. The secondary rail is designed for reciprocal movement along the X axis between adjacent work spaces. This movement is actuated by a servomotor supported on the secondary rail. The finger units themselves are designed for lateral movement toward and away from the workpiece and are actuated by additional servomotors. In order to raise and lower the workpieces, lift columns are provided upon which the transfer rail is mounted. These lift columns are also actuated by electric servomotors. Hence, according to Schafer's design, only the servomotors which cause lateral movement of the finger units are actually carried along the secondary rails, thus reducing the size of the rails, simplifying the system and making it less prone to failure. Less of the mechanism is actually disposed within the press, thus providing a less obstructed operation thereof. However even with Schafer's improvements, much of the mechanism is still disposed on the transfer rails. Furthermore, existing systems cannot be modified to add these improvements.

It would be desirable to provide transfer rails which are supported in the center to allow a much smaller rail cross section and permit the transfer system to be built to any length. Such a modular system would provide the capability of building longer transfer systems than is presently possible.

It would also be desirable to provide a more flexible transfer system permitting a multiplicity of rail positions and adjustment of finger unit travel in each of the three directions of travel.

Further, it would be desirable to provide an improved, economical system whereby the finger units may be disposed on the rails in relation to the workpiece during die building and tryout, when a transfer press is typically not available. Such a system should also allow greater accessibility to the dies during maintenance and repair by containing the actuator system for the transfer mechanism in separate modules which may be removed, leaving the rails in proper position in relation to the workpiece.

It would also be desirable to provide a system which can be used in a die shop to simulate the action of any transfer press in order to check for proper clearances of moving parts of the dies in relation to the path of travel of the transfer rail, finger units and workpieces without the necessity of actually setting the dies in a transfer press.

It would be highly advantageous to devise a modular system wherein modules may be manufactured in a limited number of sizes and can be used with presses of a variety of sizes and of various configurations, regardless of the direction of feed or of the press design.

SUMMARY OF THE INVENTION

The present invention provides a modular system particularly useful for transferring work pieces along a series of equally spaced, aligned work stations. While the preferred embodiment of the invention is used with a transfer feed press, the system is useful for transferring workpieces in any system having a series of equally spaced work stations aligned linearly along an axis whereon a predetermined sequence of operations is performed on the workpieces.

In the preferred embodiment a pair of spaced and parallel transfer rails extend longitudinally along both sides of the aligned work stations. Preferably, the pair of rails is side mounted in order to allow access to the press. A plurality of workpiece gripping finger operators which are adapted to grip the workpiece and transfer it between adjacent work stations are mounted on an individually controllable finger operator rail which, in turn, is mounted on each transfer rail.

Each of the finger operators extends laterally toward its associated work station and terminates in a free end having a workpiece engaging mechanism mounted thereon. The workpiece engaging mechanism is adapted to grip or support the workpieces and transfer them between adjacent work stations. In one embodiment, the workpiece engaging mechanism comprises horizontally extended fingers which are adapted to lift the workpiece from underneath. With the horizontally extending finger type of workpiece engaging mechanism which lifts the workpieces up, two parallel transfer rails and associated finger operator rails are provided which lift the workpieces on both sides. Such a system is suitable for transferring relatively large and heavy workpieces such as are commonly subject to stamping operations in a transfer press.

Individually controllable means are provided for imparting reciprocal linear motion to the finger operator rails along the direction of travel of the workpieces as they pass through the series of aligned work stations. The finger operator rail is slidably mounted on the transfer rail.

At least one actuator unit is provided which is supported independently from the transfer rail and is disposed at a location displaced laterally therefrom on a side thereof opposite the work stations. If a pair of transfer rails are provided, then at least one pair of actuators will be provided, with one disposed beside each transfer rail. Each actuator unit has a laterally extending arm or carriage which supports the transfer rail and is adapted to impart both lateral and up and down motion thereto. The lateral motion is along the Y axis in a direction corresponding to movement of the finger operators into and out of engagement with the workpieces. The up and down motion is along the Z axis and corresponds to movement of the finger operators for raising and lowering the workpieces.

In a preferred embodiment, the actuator unit comprises a dual axis hydraulic actuator operating the arm in the Y and Z axes to engage and lift a workpiece, then lower and retract once the workpiece has been translated to the next work station by the finger operator rail. The hydraulic actuator comprises a pair of hydraulic fluid cylinders connected in parallel to a single fluid source driven by an independent motor. As the source outputs fluid, the arm will first be moved along the axis providing the least resistance until the arm reaches a stop. The arm then begins movement along the second axis, since that axis then provides the least resistance to movement. In this manner, the actuator unit automatically achieves sequencing of its driving forces without the need for additional timing apparatus.

In a preferred embodiment, the actuator unit and its motor are supported independently of and remains stationary with respect to the motion of the transfer rail. In another embodiment, the actuator units comprise modular units which may easily be moved into and out of operating relationship with the transfer rails.

The transfer system of the instant invention possesses the advantages of providing movement of the finger operators in all three directions necessary to effect transfer of the workpieces and realignment thereof. In contrast to prior art systems, none of the actuators or motors which provide movement in the three directions are disposed on the transfer or finger operator rail itself. Hence, the transfer rail may be made smaller and lighter. Furthermore, the actuator units are independently supported from the transfer rail, resulting in an efficient, modular system.

Preferably, the transfer system further comprises at least one sensor means for detecting the state of operation of the associated production system for purposes of synchronizing the operation of the transfer mechanism to the system. In the case of a transfer press, a sensor means is be mounted on the press ram in order to sense the position of the ram during each stroke of the press. The sensor is operatively connected to a means for centrally controlling movement of the transfer rail and finger operator rail to synchronize travel of the workpieces through the successive work stations in timed relation with performance of the sequence of operations. Through this central control system, a large number of complicated transfers and multiple realignments may be performed in synchronized fashion with the operation of the press in a quick, accurate and efficient manner.

A linear actuator for imparting reciprocal motion to the finger operator rail is associated to move with, but supported independently from, the transfer rail. A motor for powering the linear actuator is supported independently of the transfer rail and remains stationary with respect to the movement of the transfer rail.

In the illustrated embodiment, the linear actuator is a belt drive system supported independently from the transfer rail and associated to move therewith and supplies the reciprocal motion to the finger operator rail. The belt drive system is powered by a independent motor which remains stationary during the operation of the transfer and finger operator rails.

The belt drive system essentially comprises a belt mounted with the transfer rail for reciprocal rotation in the direction of travel of the workpieces. The belt is driven by a transverse spline shaft which can move with the lateral displacement of the transfer rail toward the workstations. The transverse spline shaft is driven by a vertical spline shaft marked for vertical movement with the transfer rail when a workpiece is lifted. The vertical spline shaft is powered by an independent motor which remains stationary with respect to the transfer and finger operator rails.

In one embodiment, the actuator units and motors for the transfer and finger operator rails are mounted on the crown of the transfer press itself to provide unobstructed access to the dies and work stations.

In the embodiment wherein a transfer rail and associated finger operator rail are provided on each side of the transfer press, each side is preferably mechanically independent of the other, but electronically synchronized to the press ram sensor. In this manner, both of the transfer rails and the finger operator rails function independently but cooperatingly to transfer workpieces between work stations.

BRIEF DESCRIPTION OF THE DRAWINGS

The above described and further features and advantages of the herein invention may best be understood by reference to the following detailed description and drawing in which:

FIGS. 4 and 5 are section views along lines 4—4, 4*a*–4*a* and 5—5 in FIG. 2*b* showing details of the connection of a reciprocal drive belt to a finger operator rail;

FIG. 4*a* is an enlarged view of the connection between the bracket and the drive belt;

DETAILED DESCRIPTION OF THE PREFERRED EMBODIMENT

Figure 1:
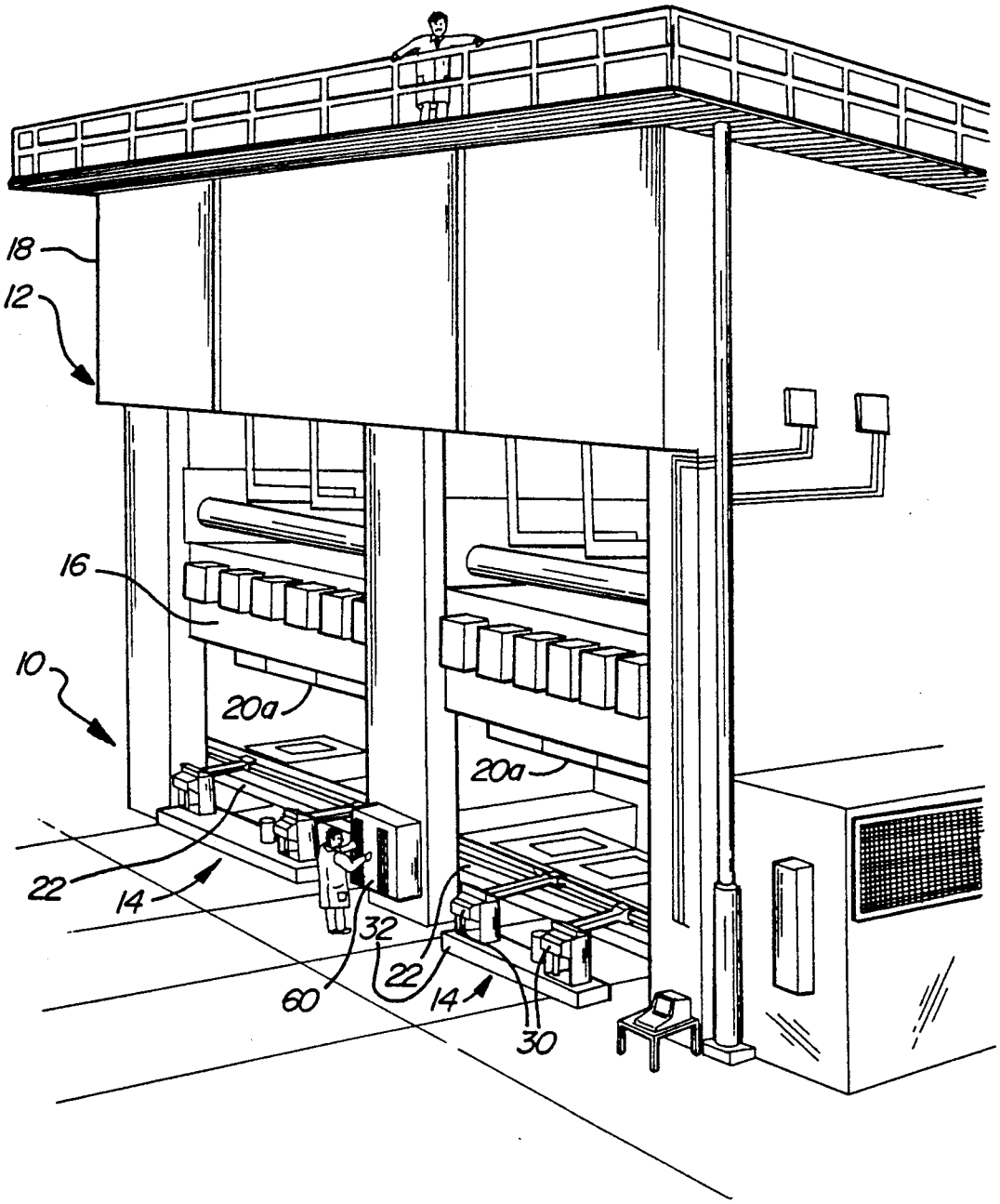
FIG. 1 is a perspective view of the transfer system of the instant invention installed in a transfer press.

Throughout the following detailed description, like reference numerals are used to refer to the same element shown in multiple figures thereof.

Figure 2:
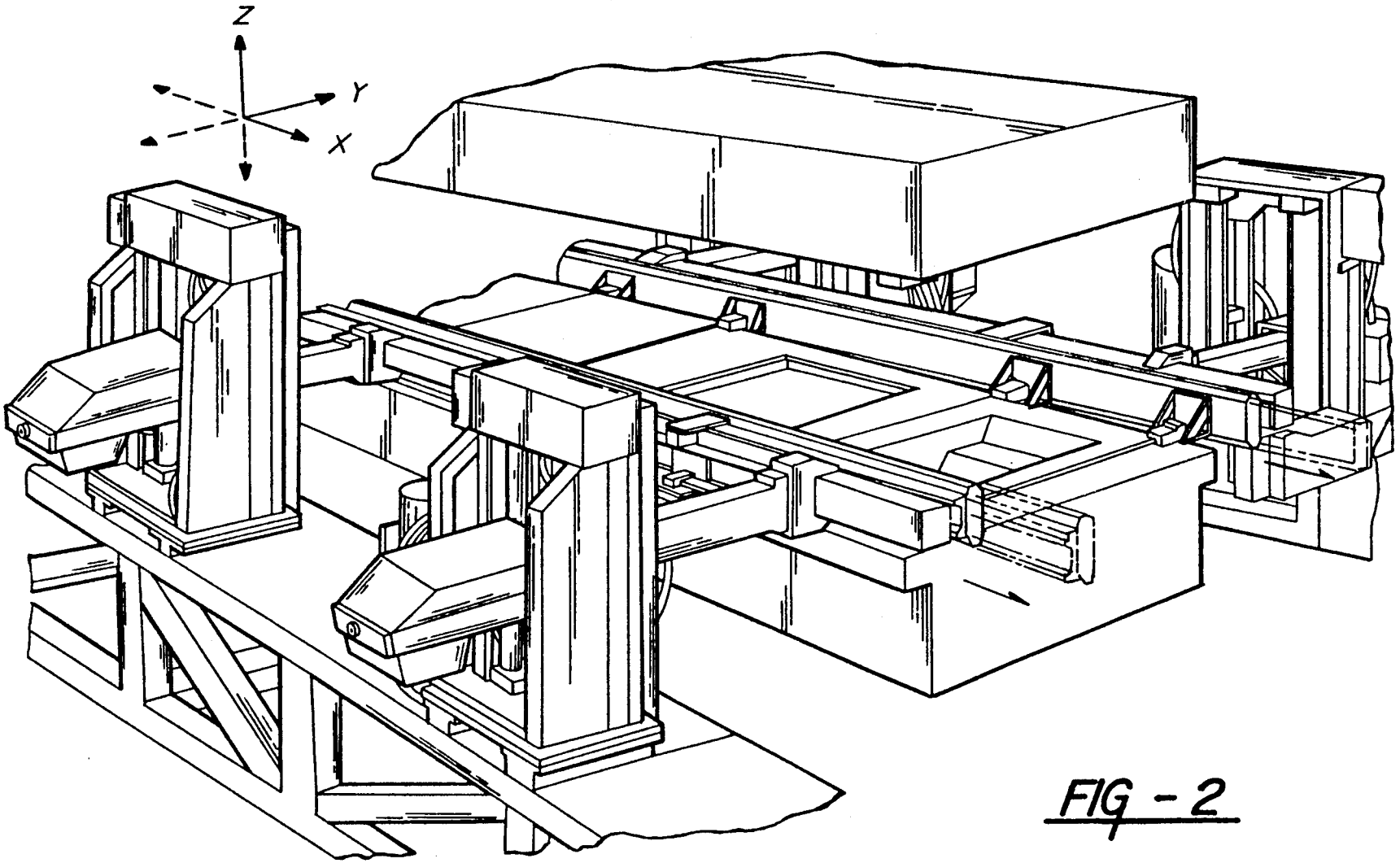
FIG. 2 is a perspective view of the transfer system of FIG. 1 shown apart from the transfer press.

Referring now to the drawing and in particular to FIGS. 1 and 2, there is shown a workpiece transfer system generally designated as 10 installed in a transfer press generally designated as 12. Transfer press 12 has a plurality of work stations 14 wherein a series of stamping operations are performed on a succession of workpieces W. A ram 16 supports a plurality of upper die halves 20*a* and each stroke of ram 16 causes the workpieces W to be stamped between an upper die 20*a* and an associated lower die 20*b* to form the workpieces W. As is conventional, the lower dies 20*b* are mounted on bolsters 22 and the upper dies 20*are* mounted on the ram 16. The upper stationary part of the mounted on the ram 16. The upper stationary part of the transfer press 12 is referred to as the crown 18.

Figure 2A:
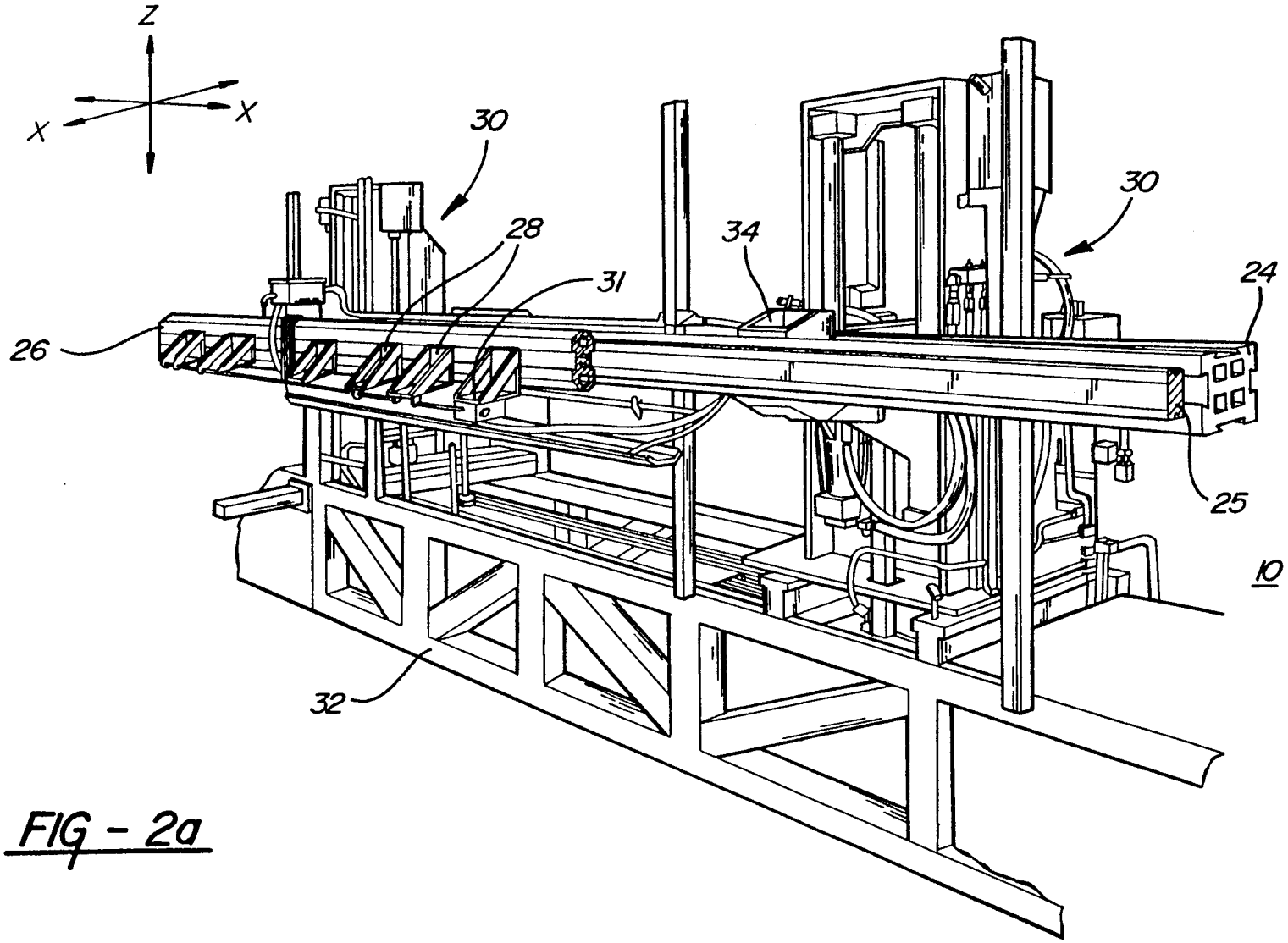
FIG. 2*a* is a perspective view of a single transfer system according to the present invention.

Extending longitudinally in parallel and spaced fashion along both sides of the plurality of work stations 14 of transfer press 12 is a transfer system generally shown in FIG. 2. While an opposed pair of transfer systems is illustrated, a single system as shown in FIG. 2*a* may be used depending on the size or type of workpieces being transferred. Transfer system 10 comprises a transfer rail 24 disposed laterally outboard of work station 14 and dies 20, running essentially parallel thereto. Mounted on each of the pair of transfer rails 24 is a finger operator rail 26 laterally inboard of transfer rail 24 adjacent work stations 14. Mounted in turn on the finger operator rails 26 are a plurality of fingers 28 which extend laterally toward the workpieces W. Each of the plurality of fingers 28 terminates in a workpiece engaging section 31. In the embodiment illustrated, each of the workpiece engaging sections 31 provides a resting place for a corner of each of the plurality of workpieces W as they are successively transferred from one adjacent work station 14 to another work station 14. It is to be understood that the plurality of workpiece engaging sections 31 may take a variety of other conventional designs and configurations, such as, for example, grasping fingers.

The plurality of finger operators 28 are equally spaced longitudinally along the transfer rail 24. In the case of the workpieces W shown in the drawing, the finger operators 28 are arrayed in pairs so that the workpiece transfer mechanisms 30 may support each corner of a workpiece W. The spacing between adjacent pairs of finger operators 28 corresponds to the spacing between adjacent work stations.

Figure 3:
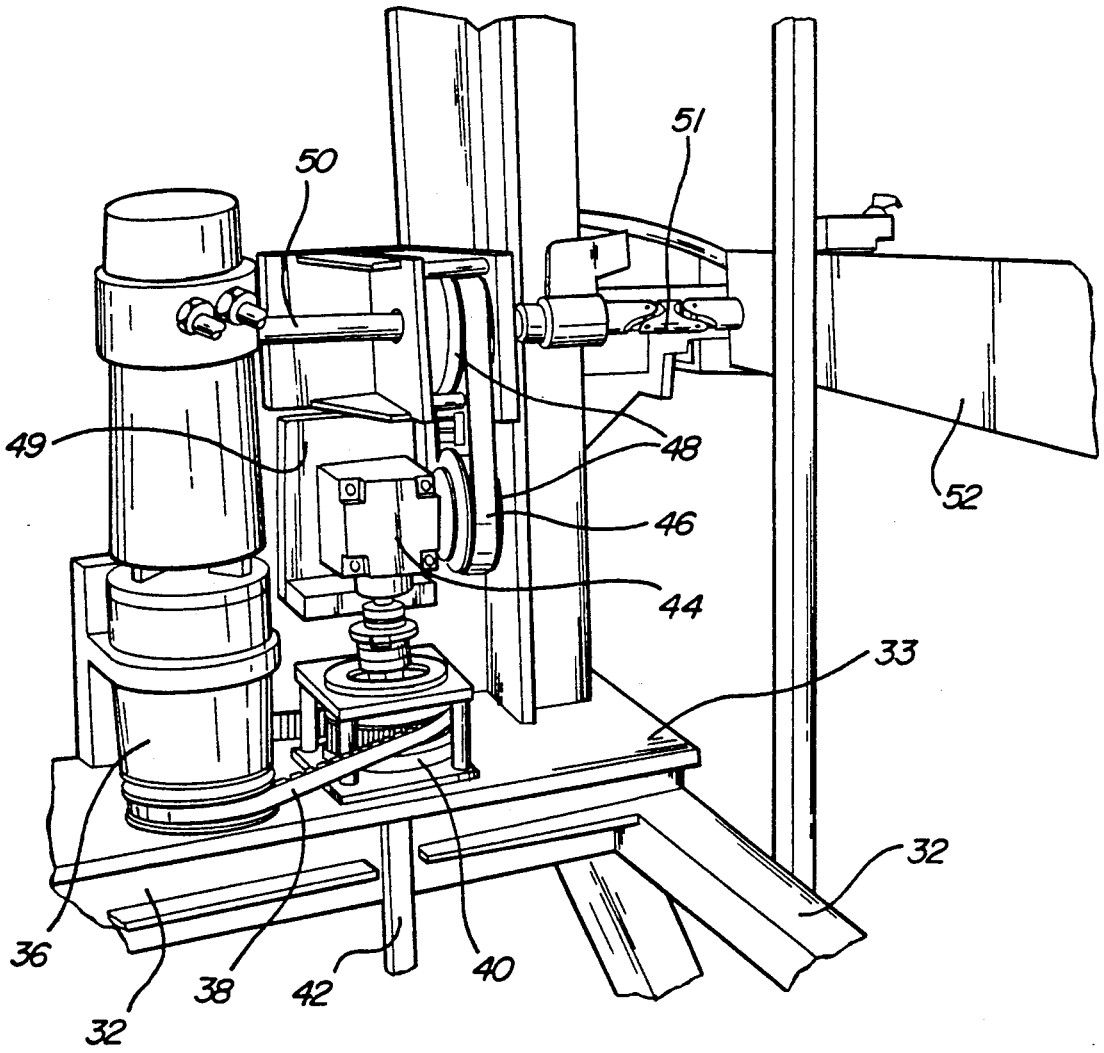
FIG. 3 is a perspective view of a motor and drive belt system associated with a transfer system according to the present invention for reciprocal actuation of a finger operator rail.
Figure 6:
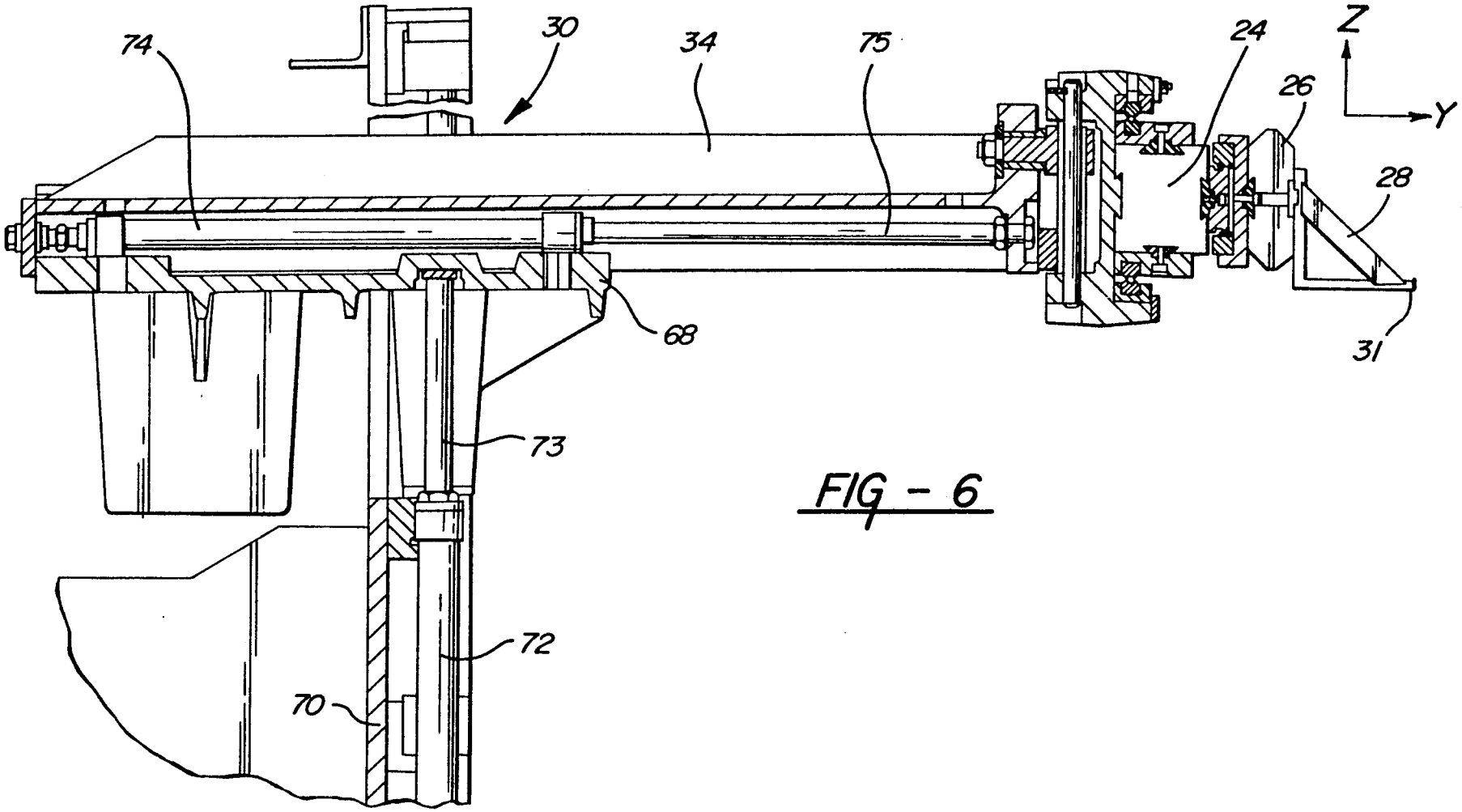
FIG. 6 is a section view along lines 6—6 showing details of a dual axis hydraulic actuator according to the present invention.

Finger operator rail 26 is slidably mounted on raceway 25 of transfer rail 24 in order to permit reciprocal, linear motion of the finger operator rail 26 with respect to transfer rail 24 along the X-axis, i.e. the direction of travel of workpieces W down the line of work stations 14 that extend along and are located at the central X-axis. Such reciprocal, linear movement of finger operator rail 26 is created by means of a belt 56 mounted within housing 52 on transfer rail 24 and powered by a belt drive system generally shown in FIG. 3. When powered by appropriately controlled electrical current, the belt drive system and belt will provide reciprocal linear motion of rail 26 with respect to rail 24.

Figure 2B:
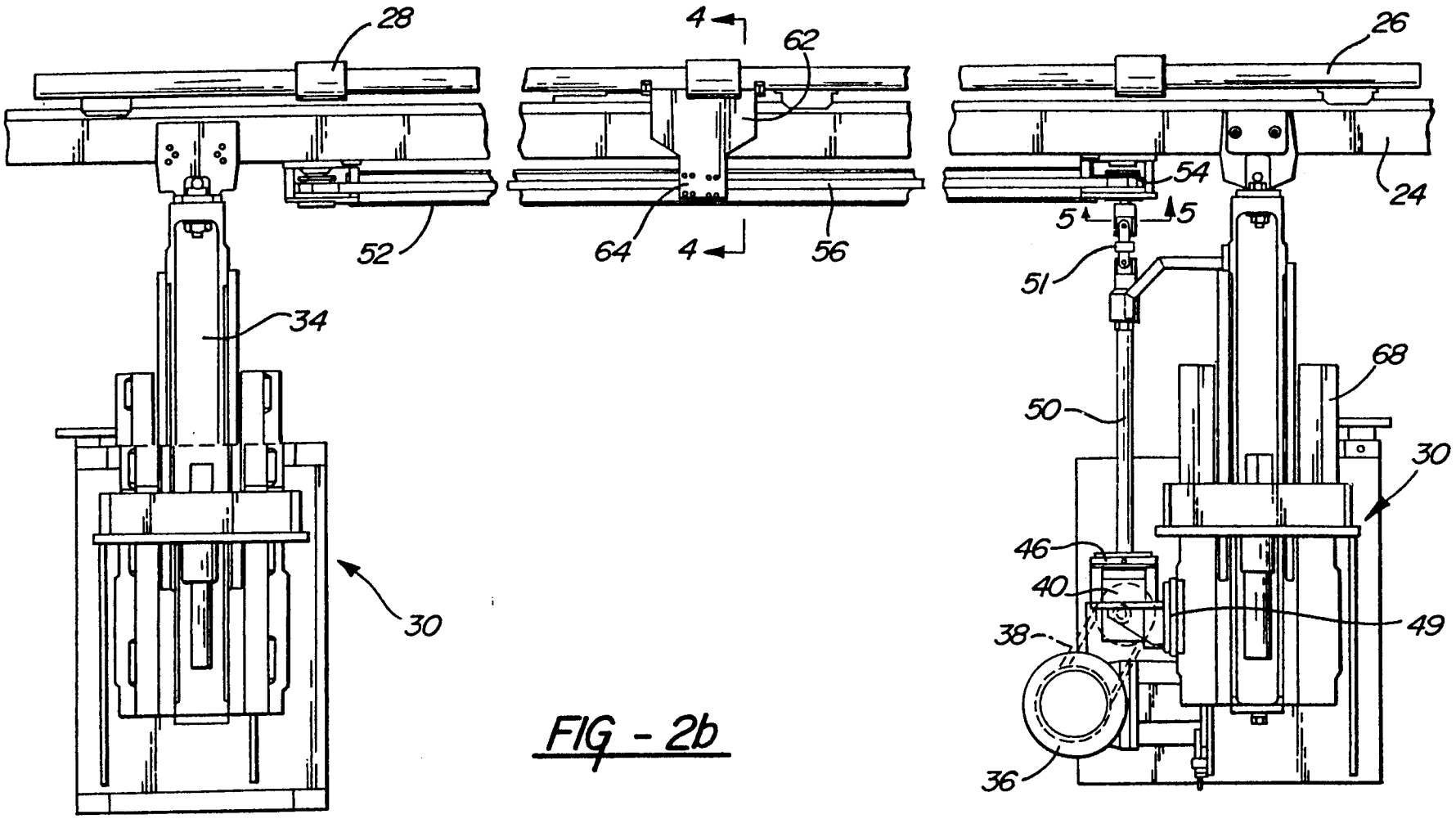
FIG. 2*b* is a partial section plan view of the transfer system of FIG. 2*a;*

The linear reciprocal movement of finger operator rail 26 along transfer rail 24 causes the finger units 28 also to move reciprocally in a linear direction along the X axis as is shown by the arrow in FIG. 2. In order to cause the finger operators 28 to move in the Z direction (up and down) and in the Y direction (laterally, into and out of engagement with the workpiece W), at least one actuator unit 30 is provided generally shown at FIG. 2*b*. Actuator unit 30 is supported independently of transfer rail 24. In the embodiment shown in FIGS. 1 and 2, actuator unit 30 is floor mounted by means of a longitudinal support frame 32 running parallel along-side the transfer press.

Actuator unit 30 could, alternatively, be mounted on or within its own modular housing equipped, for example, with rollers or casters to permit the actuator unit to be easily moved into and out of operating relationship with the transfer press.

Actuator unit 30 includes a laterally extending arm or transfer carriage 34 which extends toward the direction of the workpiece and which supports transfer rail 24. In the embodiment shown in FIGS. 2*a* and 2*b*, a pair of actuator units 30 and associated transfer carriages 34 are provided in order to adequately support the, transfer rail 24. It is contemplated that at least one actuator unit 30 will be needed for each transfer rail 24, and typically, at least one pair of actuator units 30 will be needed to support each transfer rail 24.

Referring to FIGS. 2*b* and 3–5, the belt drive system and belt drive motor for causing the reciprocal sliding movement of finger operator rail 26 along the X-axis is shown in detail. The belt drive system is powered by a reciprocal rotary motor 36 connected by belt 38 to a drive wheel 40 slidably engaging vertical spline shaft 42. Reciprocal rotary motion given to spline shaft 42 by motor 36 is transferred via gear box 44, belt 46 and drive wheels 48 to transverse spline shaft 50. Transverse spline shaft 50 is connected through the wall of housing 52 on transfer rail 24 to a drive wheel 54 positioned therein as shown in FIG. 5. Drive wheel 54 has an unpowered counterpart longitudinally spaced therefrom in housing 52 and a drive belt 56 is mounted between the two wheels. It can be seen that reciprocal rotary motion of motor 36 will be transferred through the drive belt system to the drive belt mounted in housing 52 on transfer rail 24.

Referring now to FIGS. 4 and 4*a*, finger operator rail 26 is shown slidably mounted laterally inward of transfer rail 24 along the Y-axis by way of bearing blocks 58 having a plurality of bearings or rollers 60 engaging raceway block 25 mounted on transfer rail 24. A support bracket arm 62 fastened to a portion of drive belt 56 by suitable mounting structure 64 extends over and across transfer rail 24 and is fixedly attached to finger operator rail 26. When drive belt 56 is reciprocated within the housing, bracket arm 62 connected to the drive belt will reciprocate finger operator rail 26 with respect to the transfer rail in the direction of motion of the drive belt, i.e. along the X-axis.

It should be noted that the drive belt system motor apparatus comprising motor 36, drive wheel 40, and belt 38 are supported on surface 33 of longitudinal support 32 independently of and stationary with respect to the transfer rail. Vertical spline shaft 42, gear box 44, belt and wheels 46 and 48 and transverse spline shaft 50 comprising the drive belt system are connected through system housing 49 to a carriage support 68 of transfer carriage 34 on actuator 30 for movement therewith along the Z-axis.

Upon lateral inward extension along the Y-axis of transfer rail 24, transverse spline shaft 50 mounted to slide within upper drive wheel 48 and connected by link assembly 51, connected to the drive belt in housing 52 will be pulled along therewith due to its sliding engagement with upper geared wheel 48. When the transfer rail is lifted by actuator unit 30 along the Z-axis, for example to lift an engaged workpiece from a work station, the drive belt system will be lifted therewith by the actuator unit as vertical spline shaft 42 slides through drive wheel 40.

When the drive belt system has been translated along both the Y and Z axes with the transfer rail, such as when a workpiece has been both engaged by the finger operators and lifted from a work station, stationary drive belt motor 36 is activated to reciprocate finger operator rail 26 and the workpiece along the X-axis between adjacent work stations. The independent support and mounting of the drive belt motor and drive belt system with respect to transfer rail 24 and finger operator rail 26 greatly reduces the weight supported thereby, permitting reduction in the size and weight of the rails and accordingly a higher rate of operation.

Referring now to FIGS. 6–9, an actuator unit 30 for importing motion along the Y and Z axes to the transfer rail is shown in section. A transfer carriage 34 supporting transfer rail 24 is slidably mounted along the Y-axis to a carriage support 68, which in turn is slidable along the Z-axis with respect to the base 70 of the actuator unit. According to the preferred embodiment of the present invention, the actuator unit comprises a dual axis actuator for driving each workpiece transferring unit and essentially consists of a lifting fluid cylinder 72 and a translating fluid cylinder 74. The lifting fluid cylinder is attached to the actuator unit base and its cylinder rod 73 is connected to the carriage support. The translating fluid cylinder is attached to the carriage support and its cylinder rod 75 is connected to the transfer carriage.

Figure 7:
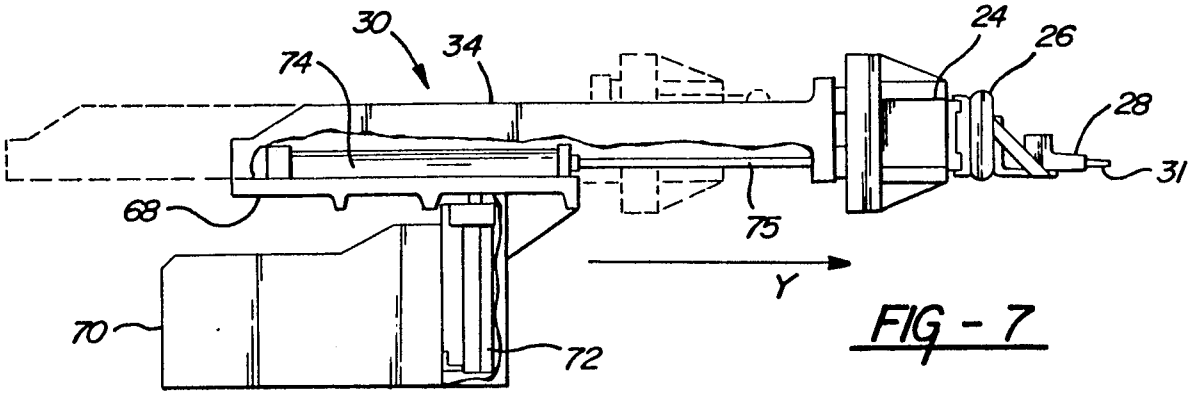
FIGS. 7 and 8 are side views of the actuator of FIG. 6 showing the motion imparted by the actuator to a transfer rail.
Figure 8:
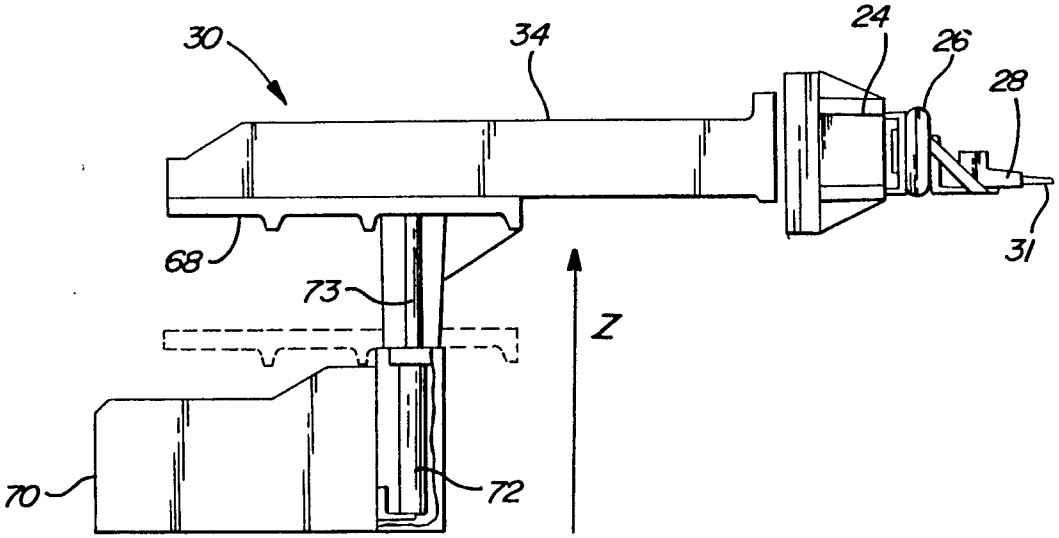

Referring now to FIGS. 7 and 8, the operation of a dual axis actuator for driving an actuator unit will be described. By extending rod 75 of the translating fluid cylinder 74, transfer carriage 34 is moved in the Y direction with respect to support 68. The solid lines of FIG. 7 show the transfer carriage 30 in the workpiece engaging position, with the retracted position shown in phantom. The action of the lifting fluid cylinder 72 and its rod 73 in moving the transfer carriage 34 and carriage support 68 in the Z direction is shown in FIG. 8. The solid lines show transfer carriage 34 in its highest, workpiece lifting position with the lower position shown in phantom. Movement of the transfer carriage 34 in the Y and Z directions causes the transfer rail 24, finger operator rail 26, and the plurality of fingers 28 to move correspondingly. These translations provide the required movements for engaging and lifting workpieces W, before translation in the X direction to the next work station 14, followed by lowering and retracting from the workpieces W, to enable clearance for the next stroke of the press.

Synchronization of all the actuator units 30 supporting a transfer rail is achieved by utilizing a centralized control unit to provide pressurized fluid through fluid conduit to drive each individual lifting fluid cylinder 72 and translating fluid cylinder 74 in the workpiece transfer system 10.

Figure 9:
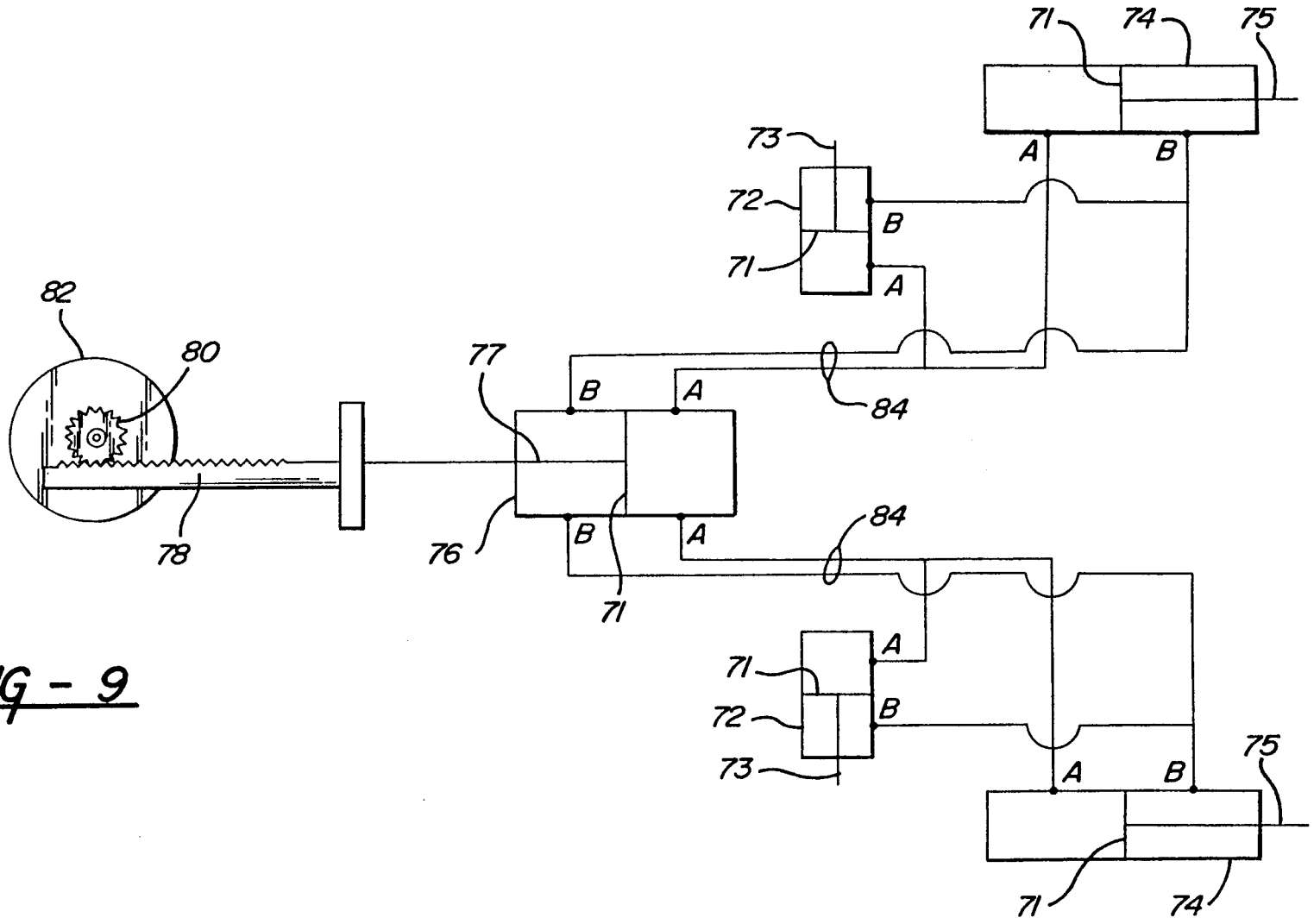
FIG. 9 is a schematic diagram of the motor and hydraulic actuating system for the actuator of FIG. 6.
Figure 10:
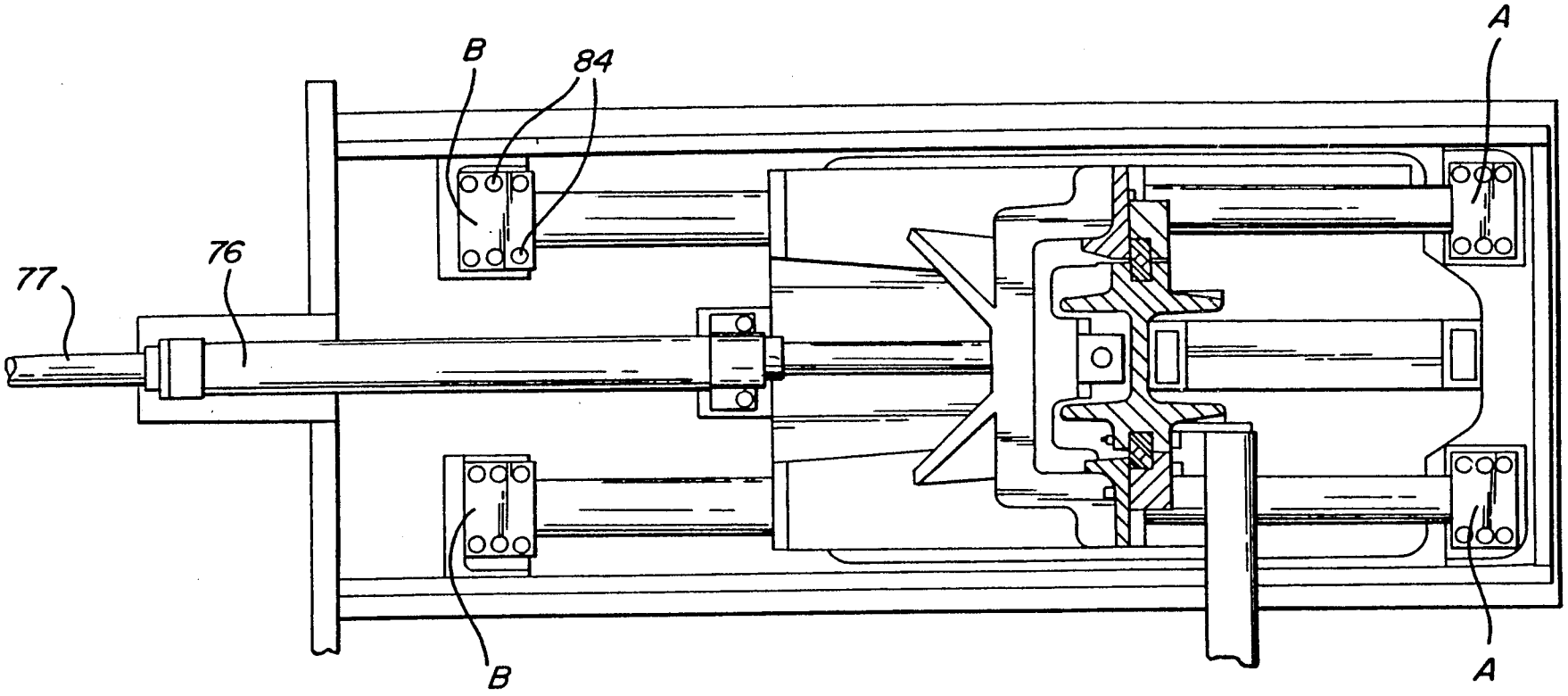
FIG. 10 is a plan view of the outer structure of the hydraulic actuating system of FIG. 9.
Figure 11:
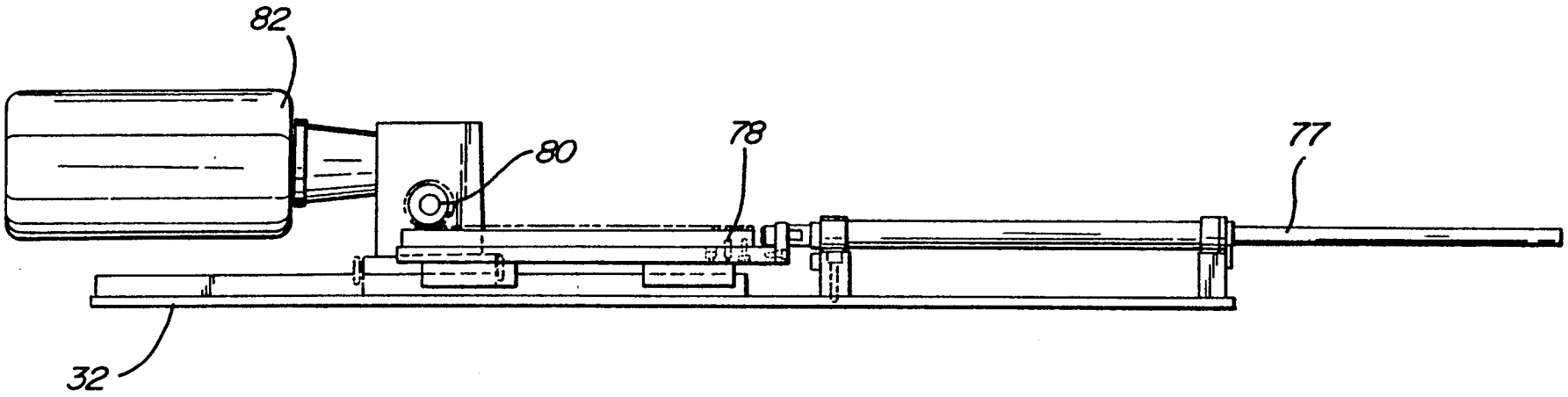
FIG. 11 is a side view of the motor for actuating the hydraulic actuating system of FIG. 9.
Figure 12:
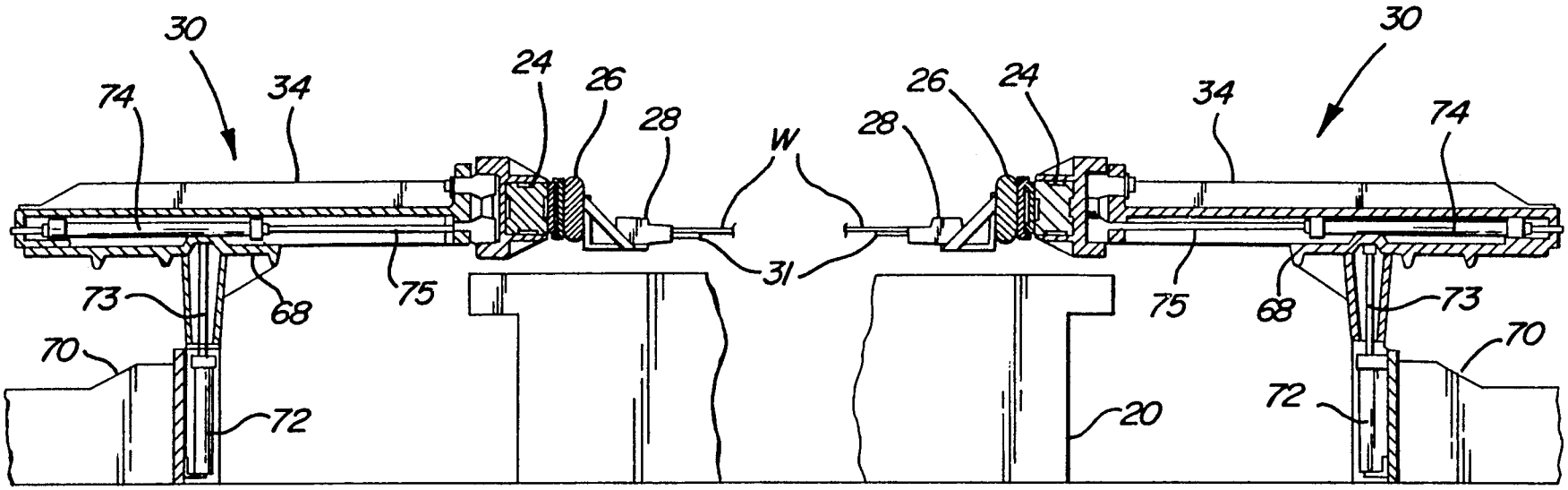
FIG. 12 is a partial section end view of opposed actuator units according to the present invention engaging and lifting a workpiece from a transfer press work station.

Schematically shown in FIG. 9 are the lifting fluid cylinders 72 and translating fluid cylinders 74 for driving two different actuator units described previously. Also shown is a source fluid cylinder 76 with cylinder rod 77 attached to a rack 78 and pinion gear 80. A rotary motor 82 operating through a rack 78 and pinion gear 80 provides reciprocal motion to cylinder rod 77 of source fluid cylinder 76. Source fluid cylinder 76, motor 82 and the rack and pinion connecting the two are shown in detail in FIGS. 10–12. In the illustrated embodiment, the structure of FIGS. 10–11 is mounted to longitudinal support 32 adjacent the floor as shown in FIG. 2*a*.

The lifting fluid cylinder 72 and translating fluid cylinder 74 have fluid ports A and B disposed on opposite sides of their pistons 71 each of which are connected to similarly denoted ports on each side of source cylinder 76.

As piston 71 of source cylinder 76 is driven toward its fluid ports denoted by A, fluid is forced out of each port A to drive each set of lifting fluid cylinders 72 and translating fluid cylinders 74. Initially, rods 75 of the translating cylinders 74 encounter much less resistance to movement than do the rods 73 of the lifting fluid cylinders 72, due to the weight of the transfer rails 24, finger operator rails 26, and the fingers 28 for engaging workpieces W, which bear down upon and must be raised by the lift cylinders 72. As a consequence, the rods 75 of the translating cylinders 74 first extend causing the fingers 28 to engage the workpieces W. Once the rods 75 of the translating cylinders 74 are fully extended, the rods 73 of the lifting cylinders 72 extend due to the now lesser resistance acting against their motion. This results in the lifting of the transfer rails 24, finger operator rails 26, and the fingers 28 holding the workpieces W.

During the second half of the cycle, rod 77 of the source fluid cylinder 76, is forced toward the fluid ports denoted by B, due to the rotary motor 82 acting through the rack 78 and pinion gear 80. Fluid is thus forced out of the fluid ports denoted B into fluid conduit 84 which feeds the fluid ports B of the translating fluid cylinder 74 and the lifting fluid cylinder 72. During this part of the cycle, the weight of transfer rails 24, finger operator rails 26, fingers 28, and associated workpieces W, assist in the retraction of the rods 73 of the lift cylinders 72. Because there is inherent bias to the retraction movement, the rods 73 of lifting cylinders 72 retract first, followed by the retraction of the rods 75 of the translating cylinders 74. Thus, the transferring mechanism lowers the workpieces W and then retracts the fingers 28.

In the preferred embodiment of the invention, a single source cylinder 76 is used to supply fluid to all sets of lifting fluid cylinders 72 and translating fluid cylinders 74 located in the different actuator units 30. This results in an automatic synchronization of all actuator units of the transfer press without gears, cams, complicated mechanical timing devices, or complex electronic servomechanisms.

Rather than using a single source cylinder 76, as shown in FIG. 9, a series of smaller diameter source cylinders can be used, each one driving a transferring fluid cylinder and a lifting fluid cylinder 78. Synchronization can be achieved by simultaneously driving all source cylinder rods 52 with rack 56.

In the preferred embodiment of the present invention, all fluid cylinders are single rod ended. In other embodiments of the invention, all single rod ended fluid cylinders can be replaced with double rod ended cylinders which have rods extending out of each cylinder end. Such single and double ended rod cylinders are commercially available and well known to those skilled in the art.

Hence, the herein workpiece transfer system permits the plurality of workpieces W to be moved along all three axes of movement. The movement of a single workpiece W during a typical cycle of transfer press 12 will now be described. In order to permit the workpiece W to be loaded onto the transfer press, typically the pair of finger operator rails 26 are made longer than the rest of the system. Assume that such loading is performed when the workpiece finger operators are in the raised, engaged position shown in solid lines in FIG. 12. That is, lift cylinders 72 are in their extended position and translating cylinders 74 and transfer carriages 66 are also extended. By operation of the previously described belt drive system, workpiece W is made to travel along the X axis toward the first work station 14. As soon as it reaches a predetermined correct position along the X axis for proper alignment with upper and lower dies 20*a* and 20*b*, movement along the X axis will cease, and lift cylinder will be retracted, thereby causing lowering of the workpiece W into the operational position. Translating cylinder 74 and transfer carriage 34 will also be retracted to disengage workpiece W from finger operators 28. The ram 16 will then be operated to cause stamping of the workpiece W between die pieces 20*a* and 20*b*. After completion of its stroke, ram 16 will lift. During the time when the finger operators are disengaged from workpiece W, during the stroke of the ram, if the die configuration permits the belt drive system may reciprocate finger operator rail 26 along the X axis in an opposite direction, thus causing a new set of finger operators 28 to be in position for engagement with workpiece W. Transfer carriage 34 will then move along the Y axis into its extended position, causing engagement of finger operators 28 with the workpiece W. Lift cylinder 72 will move rod 73 along the Z axis into its extended position to lift the workpiece back into the position shown in FIG. 12. After engagement of finger operators 28 with workpiece W and the lifting of the workpiece, as described above, the belt drive system will then displace workpiece W along the X axis for a sufficient distance to cause it to be aligned with the next work station 14. The cycle is then repeated. At each cycling of the transfer system 10, a plurality of workpieces are transferred between each adjacent work station 14. In order for a single workpiece W to travel through all of the plurality of work stations 14, it will be necessary for the system to cycle as many times as there are work stations 14.

Obviously, in order to keep the system operating correctly and efficiently, it is necessary that each one of the single displacements of the plurality of workpieces W through all three axes must be performed accurately with respect to both distance displaced and time of displacement. To that end, it is contemplated that each transfer rail, and accordingly the plurality of actuators 30 and belt drive systems associated therewith, be independently controllable. The independent control means (not shown) for each side of the transfer system is connected to a central controller 60, shown in FIG. 1. Sensor means such as an absolute position transducer (not shown) are associated with the press ram in a well-known manner are used to sense the position of the rams 16. By feeding information from the sensor means into central control means 60, the operation of each mechanically independent side of system 10 may be electronically coordinated so that transfer and alignment of the plurality of workpieces W is synchronized with one another and with the operation of transfer press 12. This can be accomplished by simultaneously actuating, in the proper sequence, the various motor means for the actuator units 30 and the drive belt systems for each transfer system 10 on each side of the press.

Since each transfer system 10 on each side of transfer press 12 is independently controllable, the system 10 may be used to realign and reposition the plurality of workpieces W as required by each stamping operation. For example, the right member of an opposed pair of finger operator rails 26 may be made to move at a faster rate than the left member. Such movement would cause the workpiece W to rotate somewhat. Similarly, movement of the actuator units 30 may be varied as necessary to adjust to required operating conditions.

As shown in the preferred embodiment, actuator units 30 are dual axis hydraulic actuators as described above. Again however the invention contemplated herein is not limited to this type of actuator, but may include other suitable means of imparting linear motion.

It may be seen how the therein system is adaptable for operation with a wide variety of different transfer press designs of varying sizes. Thus, in an installation having transfer presses of various types, it is possible to move the operating system 10 from one transfer press to another. The transfer system is modular, and as many components may be added as are necessary to accommodate the size of the press and the number of work stations therein. The actuator units 30 may be used with existing systems having die mounted transfer rails which utilize a cross slide bracket. Hence, retrofitting of existing systems is inexpensive and easy. Furthermore, when die change operations are necessary, it is much easier to disassemble the system of the present invention than is the case with prior art systems. Furthermore, in contrast to prior art systems where the various actuator, motor and drive components are mounted directly on the transfer rail and interfere with operation of the press, the actuators, motors and drives of the present system are deployed outboard of the press itself and supported independently from the transfer and finger operator rails, thus resulting in easier operation, as well as in a reduction of the bulk of the rail necessary to support the system.

Figure 13:
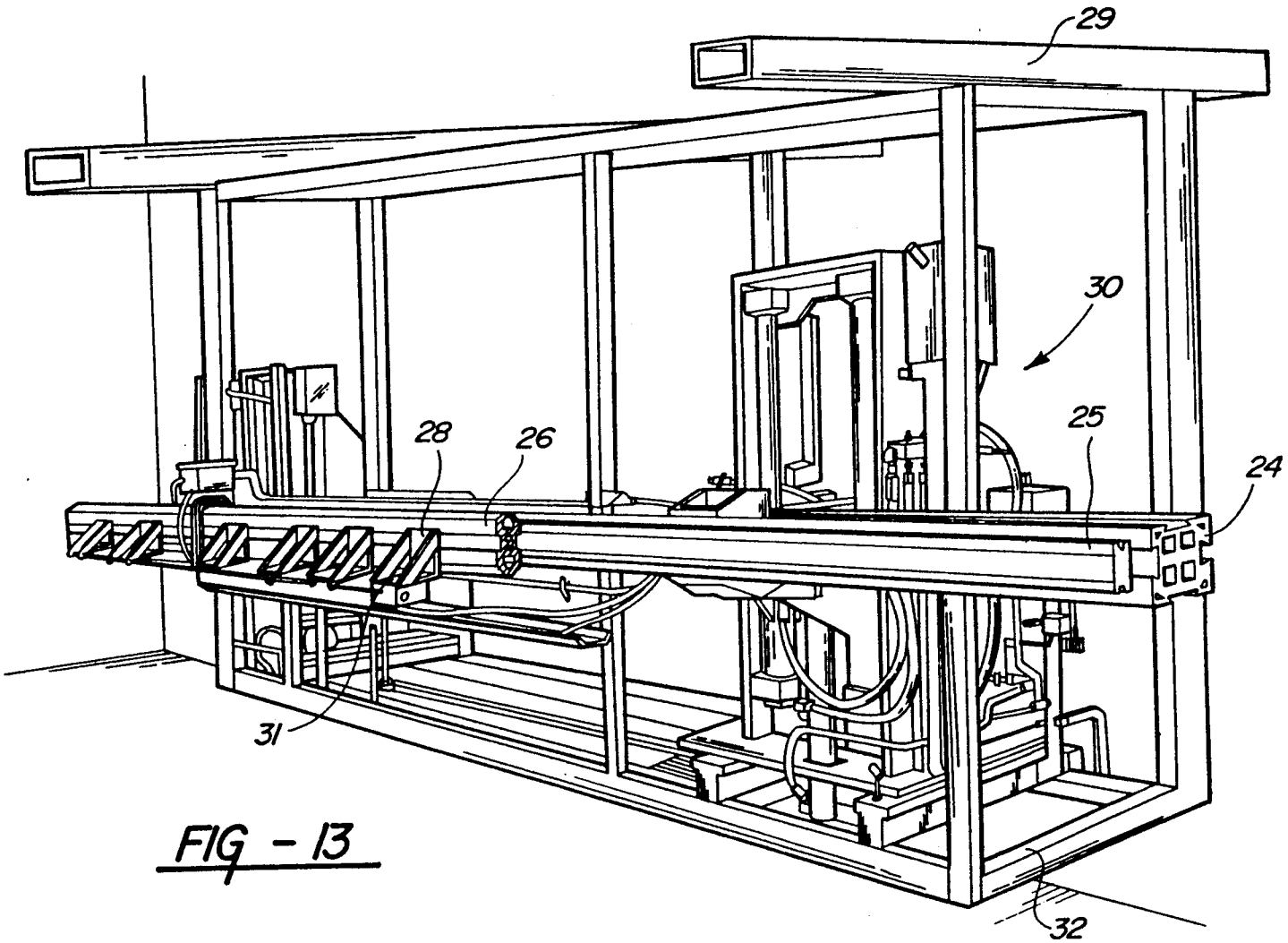
FIG. 13 is a perspective view of a transfer system according to the present invention adapted t be mounted from the overhead stationary crown of a press.

In an alternate embodiment shown in FIG. 13, the transfer system of the present invention is mounted or depends from the upper stationary press crown shown in FIG. 1 via a support frame 29. This transfer system arrangement functions in the same manner as previously described, but greatly increases available floor space adjacent the transfer press and provides unobstructed access thereto. As will be apparent to those skilled in the art, support frame 29 may take various forms, and the dimensions of the actuator units may vary to accommodate such overhead mounting.

While the herein embodiment has been described installed in a transfer press, it is contemplated that it may be adapted for use in any system requiring repetitive transfer of a plurality of workpieces from one equidistant work station to another. For example, such repetitious transfer may be needed in operating a punch press, a coating system, a paint sprayer, etc. Furthermore, other such applications may occur to one skilled in the art without departing from the spirit of the herein invention.

Therefore, the scope of the present invention is not limited to the embodiments and exemplifications depicted and described herein, but rather by the claims appended hereto.

What is claimed is:

1. For use in conjunction with an article forming press which includes a ram having an upper die associated therewith adapted to be driven along a path of travel in a Z-axis and engagable with a lower die supported by a bolster for forming a workpiece inserted therebetween, a system for transferring workpieces between work stations aligned linearly along and at a central X axis perpendicular to the Z axis, to perform a predetermined sequence of operations on the workpieces, said system comprising:

a transfer rail extending longitudinally in spaced and parallel relation to the X axis and having a finger operator rail mounted thereupon for movement with respect thereto in a direction parallel to the X-axis;

said transfer rail and finger operator rail being laterally displaced with respect to the X axis from each other with said finger operator rail mounted inboard from the transfer rail;

a plurality of workpiece gripping finger operators mounted on the finger operator rail at equally spaced locations thereon corresponding to the spacing of the work stations, said finger operators extending laterally in a Y axis, perpendicular to the X axis and Z axis and each terminating in a free end having a workpiece engaging section adapted to engage the workpieces and transfer them between adjacent work stations;

drive means for imparting reciprocal motion, along the X-axis, to the finger operator rail for a distance equal to the spacing between adjacent work stations;

drive means for imparting reciprocal motion along the Y-axis to the transfer rail for a distance permitting engagement of said finger operators with said workpiece;

drive means for imparting reciprocal motion along the Z-axis to the transfer rail for a distance permitting transfer of said workpieces between work stations along the X-axis; and motor means operating said drive means for said finger operator and transfer rails, said motor means supported separately from said finger operator and transfer rails to remain stationary with respect to the movement of said finger operator and transfer rails.

2. The system as defined in claim 1 wherein one of said transfer systems is positioned on each side of said sequence of work stations.

3. The system as defined in claim 2 wherein each of said transfer systems operates mechanically independently of and electronically synchronized with the other said systems to simultaneously transfer workpieces between the work stations.

4. The system as defined in claim 3 wherein said transfer systems are synchronized to a signal corresponding to the position of said ram along the Z-axis with respect to said work stations.

5. The system as defined in claim 1 wherein said article forming press includes a stationary press crown overlying said ram and said transferring system depends from and is supported by said press crown.

6. The system as defined in claim 1, wherein said finger operator rail is mounted laterally inboard of said transfer rail adjacent said work stations.

7. For use in conjunction with an article forming press which includes a ram having an upper die associated therewith adapted to be driven along a path of travel in a Z-axis and engagable with a lower die supported by a bolster for forming a workpiece inserted therebetween, a system for transferring workpieces between work stations aligned linearly along an X axis perpendicular to the Z axis, to perform a predetermined sequence of operations on the workpieces, said system comprising:

a transfer rail extending longitudinally in spaced and parallel relation to the X axis and having a finger operator rail mounted thereupon for movement with respect thereto in a direction parallel to the X-axis;

a plurality of workpiece gripping finger operators mounted on the finger operator rail at equally spaced locations thereon corresponding to the spacing of the work stations, said finger operators extending laterally in a Y axis, perpendicular to the X axis and Z axis and each terminating in a free end having a workpiece engaging section adapted to engage the workpieces and transfer them between adjacent work stations; and drive means for imparting reciprocal motion, along the X-axis, to the finger operator rail for a distance equal to the spacing between adjacent work stations;

driven means for imparting reciprocal motion along the Y-axis to the transfer rail for a distance permitting engagement of said finger operators with said workpiece;

drive means for imparting reciprocal motion along the Z-axis to the transfer rail for a distance permitting transfer of said workpieces between work stations along the X-axis; and motor means operating said drive means for said finger operator and transfer rails, said motor means supported separately from said finger operator and transfer rails to remain stationary with respect to the movement of said finger operator and transfer rails wherein said driven means for said finger operator rail comprises a belt driven system mounted to move with said transfer rail.

8. Apparatus as defined in claim 7, wherein said motor means for said belt driven system comprises a rotary motor, said motor independently of and stationary with respect to said belt drive system.

9. Apparatus as defined in claim 8 wherein said belt driven system comprises a first spline shaft engaged by said motor means and mounted for reciprocal movement with said transfer rail along the Z-axis, and a second spline shaft engaged by said first spline shaft, said second spline shaft mounted for reciprocal movement along the Y-axis with said transfer rail.

10. Apparatus as defined in claim 9 wherein said second spline shaft is connected to drive a reciprocating belt mounted to move with said transfer rail and connected to said finger operator rail to reciprocate said finger operator rail along the X-axis with respect to said transfer rail.

11. A system as defined in claim 7 further characterized by:

said belt drive system being positioned outboard of said transfer rail and includes a drive belt and a bracket arm attached to both said drive belt and said finger operator rail, said bracket arm extends across said transfer rail.

12. For use in conjunction with an article forming press which includes a ram having an upper die associated therewith adapted to be driven along a path of travel in the Z-axis and engagable with a lower die supported by a bolster for forming a workpiece inserted therebetween, a transfer system for transferring workpieces between work stations aligned linearly along and at a central X-axis perpendicular to the Z-axis, to perform a predetermined sequence of operations on the workpieces, said system comprising:

a transfer rail extending longitudinally in spaced and parallel relation to the X-axis and having a finger operator rail mounted thereupon for movement with respect thereto in a direction parallel to the X-axis, said finger operator rail being mounted entirely between said transfer rail and said central X-axis;

a plurality of workpiece gripping finger operators mounted on the finger operator rail at equally spaced locations thereon corresponding to the spacing of the workstations, said finger operators extending laterally inboard from the transfer rail in a Y-axis, perpendicular to and toward the central X-axis and Z- axis and each terminating in a free end having a workpiece engaging section adapted to engage the workpieces and to transfer them between adjacent work stations;

at least one actuator unit supported independently from the transfer rail and disposed in a location displaced laterally along the Y-axis from the article forming press, said actuator unit having a transfer carriage which extends therefrom in the Y-direction and which is operative to move the transfer rail along both the Y and Z axes;

driven means for said finger operator rail supported independently of and associated to move with said transfer rail; wherein, said driven means and said actuator unit are powered by motor means which are means stationary with respect to the movement of said finger operator and transfer rails.

13. A system as defined in claim 12 further characterized by:

said driven means for said finger operator rail includes a belt drive system mounted outboard of said transfer rail and includes a drive belt and a bracket arm attached to said drive belt and said finger operator rail, said bracket arm extends across said transfer rail.

14. The system as defined in claim 12 wherein said article forming press includes a stationary press crown overlying said ram and said press crown independent of other independent ground support.

15. A transfer press automation system for transferring workpieces along a series of equally spaced, aligned workstations at a central X-axis of a transfer feed press having a ram associated therewith, said system comprising:

a transfer rail extending along and in spaced relation to the central X-axis and extending longitudinally along a side of said workstation;

an individually controllable finger operator rail mounted on an inboard side of said transfer rail for reciprocal movement with respect thereto for a distance equal to the spacing between adjacent workstations and in a direction corresponding to the X-axis and defining the direction of workpiece movement through the workstation said finger operator rail being mounted entirely between said transfer rail and said central X-axis;

linear driven means associated with said transfer rail and its associated finger rail, said linear driven means operative to effect the movement of the finger rail;

a plurality of workpiece-engaging fingers supported on the finger rail at equally spaced locations thereon corresponding to the spacing of a series of workstations, each of said fingers extending laterally away from the transfer rail along a Y-axis perpendicular to and toward the X-axis and terminating in a free end having a workpiece engaging mechanism mounted thereon adapted to engage the workpiece;

an actuator unit associated with the transfer rail and disposed along the Y-axis and on the side of the transfer rail opposite the series of workstations, said actuator unit adapted to support the associated transfer rail and impart reciprocal motion thereto directions corresponding to both the Y-axis and a Z-axis which is perpendicular to the X and Y axes and defining, respectively, the direction of finger workpieces and the movement of the finger operators for raising and lowering the workpieces; where, said actuator unit and said linear drive means are powered by motor means which are mounted independently from and which remain stationary with respect to said finger operator and the transfer rails.

16. A system as defined in claim 15 further characterized by:

said drive means for said finger operator rail includes a belt drive system mounted outboard of said transfer rail and includes a drive belt and a bracket arm attached to said drive belt and said finger operator rail, said bracket arm extends across said transfer rail.

17. The system as defined in claim 15 wherein said transfer feed press includes a stationary press crown overlying said ram and said transfer rail, finger operator rail, linear drive means, and said actuator unit depend from said stationary press crown independent of other ground support.

* * * * *

UNITED STATES PATENT AND TRADEMARK OFFICE

CERTIFICATE OF CORRECTION

PATENT NO. : 5,003,808

DATED : April 2, 1991

INVENTOR(S) : John H. Maher

It is certified that error appears in the above-identified patent and that said Letters Patent is hereby corrected as shown below:

Column 6, Line 18, Please delete "t be" and insert -- to be --.

Column 6, Line 37, Please delete "20are" and insert -- 20a are --.

Column 6, Line 68, Please delete "transfer mechanisms 30" and insert -- engaging sections 31 --.

Column 7, Line 40, Please delete "the, transfer" and insert -- the transfer --.

Column 14, Line 57, Please delete "driven" and insert -- drive --.

Column 14, Line 60, Please delete "driven" and insert -- drive --.

Column 13, Line 51, Please delete "driven" and insert -- drive --.

Column 13, Line 64, Please delete "driven" and insert -- drive --.

Column 13, Line 65, Please delete "driven" and insert -- drive --.

UNITED STATES PATENT AND TRADEMARK OFFICE

CERTIFICATE OF CORRECTION

PATENT NO. : 5,003,808

DATED : April 2, 1991

INVENTOR(S) : John H. Maher

It is certified that error appears in the above-identified patent and that said Letters Patent is hereby corrected as shown below:

Column 13, Line 68, Please delete "driven" and insert -- drive --.

Column 14, Line 4, Please delete "driven" and insert -- drive --.

Column 14, Line 66, Please delete "driven" and insert -- drive --.

Column 15, Line 25, Please delete "driven" and insert -- drive --.

Column 15, Line 26, Please delete "driven" and insert -- drive --.

Signed and Sealed this

Twenty-seventh Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,003,808

DATED : April 2, 1991

INVENTOR(S) : John H. Maher

It is certified that error appears in the above-identified patent and that said Letters Patent is hereby corrected as shown below:

Column 14, line 57 and 60 "driven" should read --drive--.

Column 14, Line 62, Delete "are means" Insert --remains--

Column 16, Line 12, before "workpieces" Insert --operator movement into and out of engagement with the--

Signed and Sealed this

Fifth Day of October, 1993

*Attest:*

*Attesting Officer*

BRUCE LEHMAN

*Commissioner of Patents and Trademarks*